US006976644B2

(12) United States Patent
Troudt

(10) Patent No.: US 6,976,644 B2
(45) Date of Patent: Dec. 20, 2005

(54) EXTENSION POLE WITH SWIVEL SPRAY NOZZLE

(76) Inventor: Kevin Troudt, 12630 Etris Rd., Roswell, GA (US) 30075

( * ) Notice: Subject to any disclaimer, the term of this patent is extended or adjusted under 35 U.S.C. 154(b) by 4 days.

(21) Appl. No.: 10/635,953

(22) Filed: Aug. 7, 2003

(65) Prior Publication Data

US 2005/0029366 A1 Feb. 10, 2005

(51) Int. Cl.[7] ..... B05B 15/08

(52) U.S. Cl. ..... 239/587.1; 239/587.5; 239/588; 239/578; 239/532; 239/530; 239/531; 239/525; 239/526

(58) Field of Search ..... 239/587.1, 587.5, 239/587.6, 578, 532, 530, 531; 15/119.1, 15/152

(56) References Cited

U.S. PATENT DOCUMENTS 1,745,972 A * 2/1930 Beck ..... 239/532
1,849,511 A * 3/1932 Thompson ..... 239/415
2,857,201 A * 10/1958 Palmer ..... 239/281
3,166,252 A * 1/1965 Williams et al. ..... 239/587.6
3,893,630 A * 7/1975 Bochmann et al. ..... 239/587.5
3,940,072 A 2/1976 Ishikawa et al.
4,323,196 A * 4/1982 Logue et al. ..... 239/532
5,372,389 A * 12/1994 Tam et al. ..... 285/94
5,894,625 A * 4/1999 Vosbikian ..... 15/119.1
5,947,388 A * 9/1999 Woodruff ..... 239/532
6,619,569 B2 * 9/2003 Jens ..... 239/526
6,685,115 B1 * 2/2004 Hardin ..... 239/587.1

* cited by examiner

*Primary Examiner*—David A. Scherbel
*Assistant Examiner*—James S. Hogan
(74) *Attorney, Agent, or Firm*—David L. Tingey

(57) ABSTRACT

A spray nozzle mounts to an extension pole end in a swivel joint. A swivel nozzle base connects to the pole and a manifold swivelly couples the base to a swivel nozzle head such that pressurized fluid passing through the pole passes into the base, through the manifold, into the head and then out of an orifice in the head through a spray tip attached to the head at the orifice. All fluid seals, O-rings, are also protected within the base. To effect head rotation and to hold the head in a preferred orientation relative to the base, a lever is attached to the head to the manifold firmly attached to the head. To move the lever on the distal end of an extension pole, it is connected to a rod that runs between the lever and an actuator on the pole. Typically, the actuator comprises a grip around the pole that slides along the pole when exercised by an operator. A spray gun is normally attached to the pole proximal end with a trigger that regulates high-pressure fluid into the pole.

30 Claims, 5 Drawing Sheets

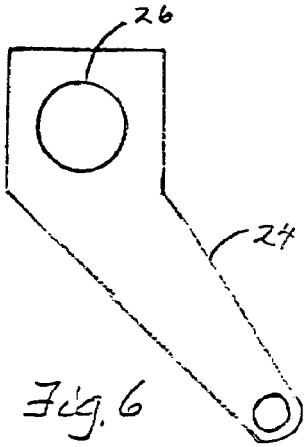
Fig. 6
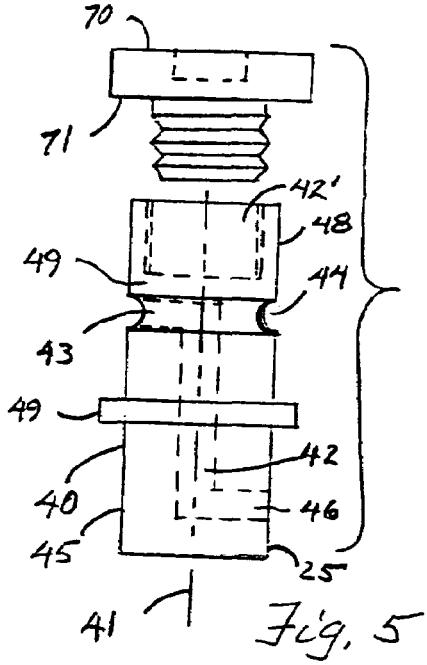
Fig. 5
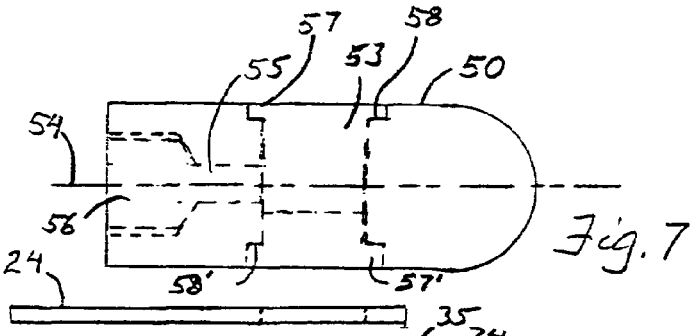
Fig. 7
Fig. 9
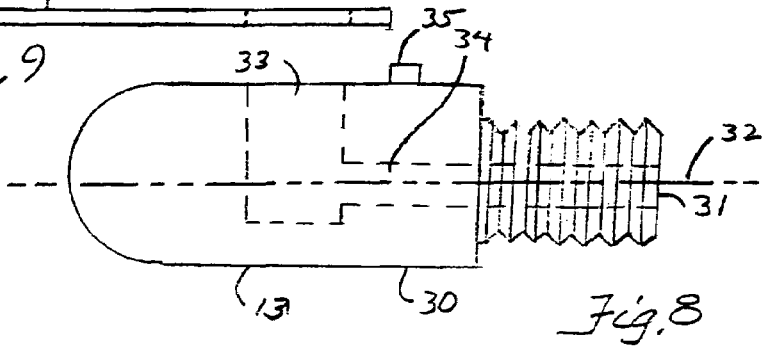
Fig. 8

EXTENSION POLE WITH SWIVEL SPRAY NOZZLE

1. Field of the Invention

This invention relates to spray nozzles and, more particularly, to a spray nozzle comprising a base and a head coupled together through a manifold in a swivel joint that enables fluid to pass into the base, through the manifold and head, and out a spray orifice in the head while the head rotatable relative to the base.

2. Background

It is known to have a spray gun on an end of an extension pole for remote spraying of paint, stain, water and other fluids. In that configuration, fluid is regulated through the spray gun by remotely actuating its trigger. The spray gun may be rotated relative to the pole end to achieve a desired orientation of the spray gun. This configuration functions admirably but could be improved if the weight of a spray gun on the extension pole end could be eliminated.

It is therefore an object of the invention to provide an extension pole with a spray nozzle on its distal end. It is a further object that fluid spray through the spray nozzle be controlled from the extension pole proximal end. It is another object that the spray nozzle spray end swivel with minimal resistance to rotation relative to the pole. It is still a further object that the nozzle be sealed from fluid leaks with sealing provisions contained within the nozzle to protect them from damage during use. It is still another object that the spray nozzle on the pole distal end be oriented remotely from the pole proximal end to a desired spray direction. It is yet another object that the spray nozzle be continually redirectable by the operator while bracing the extension pole during use.

SUMMARY

This is achieved in a spray nozzle mounted directly to an extension pole end in a swivel joint comprising a base connected to the pole, a head able to swivel relative to the base, and a manifold coupling the base to the head such that pressurized fluid passing through the pole passes into the base, through the manifold, into the head and then out of an orifice in the head, typically through a spray tip attached to the head at the orifice. The manifold provides a fluid conduit between the base and the head that allows the head to rotate while maintaining a fluid seal between the base and the head.

The base and the head each have a bore perpendicular to their axes aligned to receive the manifold therethrough. A bolt threads into the manifold base end, terminating within the base when the manifold is installed in the base, compressing a first O-ring seal between the bolt head and a shoulder of an upper recess in the base. When the bolt and the manifold pull together as the bolt threads into the manifold, a sheif circumferential about the manifold on the base under side, opposite the bolt head on the base upper side compresses a second O-ring seal between the shelf and a shoulder of a lower recess in the base. The degree of compression of the O-rings is thereby adjusted by the degree of tightening of the bolt into the manifold. The base has an axial passageway between a base entry orifice and the base bore that aligns with a manifold upper circumferential groove. A manifold upper passageway coplanar with the base passageway and radial to the manifold axis connects to a manifold axial passageway. Thus, the first and second O-rings effect a fluid seal between the base and the manifold passageways.

The manifold lower head portion below the shelf extends into the head bore perpendicular to the head axis, typically press fit together in a fluid seal, although any other similar connection is possible and deemed included in this disclosure, such as a threaded manifold lower portion engaging matching threads in the head bore. An axial head passageway connects between the head bore and a head discharge orifice similar to the base axial passageway. The head also has an axial passageway between a head discharge orifice and the head bore that aligns with the manifold lower circumferential groove. A manifold lower passageway coplanar with the head passageway and radial to the manifold axis connects to a manifold axial passageway. Thus, fluid communication is provided between the base entry orifice and the head discharge orifice while rotation of the head is enabled relative to the base, fluid communication continuing through the manifold circumferential grooves with the rotation. Thus configured the head rotates freely on the base a full 360 degrees.

Significantly, there is a fluid seal between the base and the manifold by way of the O-rings circumferentially around the manifold and between the manifold and the head, typically by way of the press fit, but not directly between the base and head. This allows the base and head to rotate without friction directly between them. It also allows the bolt to tighten the manifold and base together sufficiently to effect the fluid seal of the O-rings without regard to the head. The O-rings are also protected within the base as opposed to exposed between the base and the head.

To effect head rotation and to rotate and hold the head to a preferred orientation relative to the base, a lever is attached to the head, or equivalently, to the manifold firmly attached to the head. With the manifold firmly secured to the head, rotation of the manifold by movement of the lever also rotates the head relative to the base. The head rotates on the base with minimal friction to accommodate quick and facile remote adjustment of head orientation. However, the head in operation under high pressure discharge of fluid creates a torque on the head and pole that tends to move the head out of a preferred orientation. Thus, the lever connected through the rod to the adjustable actuator on the pole maintains the head properly oriented during operation in opposition to reaction forces derived from discharge of the high pressure fluid from the head.

Typically, the swivel nozzle is mounted on the distal end of an extension pole and used to spray fluid remotely. The configuration is useful, for example, in painting and pressure washing and any other situation where pressurized fluid could be delivered from a remote position or to a difficult to reach location. And then when the spray base is positioned in that location, it is oriented adjustably toward the spray target by movement of the lever.

To move the lever on the distal end of the extension pole, it is connected to a rod that runs between the lever and an actuator on the pole, typically intermediate the pole and within reach of the operator at the pole proximal end. Typically, the actuator comprises a grip around the pole that slides along the pole when exercised by the operator. Therefore, any sliding movement of the hand grip on the pole causes rotation of the head on the base. Thus configured, The operator is able to support The pole with one hand on the grip as one would normally support an extension pole with one hand along the pole to stabilize and manipulate the pole while also using that bracing hand to control the nozzle orientation.

The lever is selectively installed relative to the head orientation such that as the actuator is moved between its position limits on the pole, the head moves through a determined range of motion, for example, between a forward orientation with the head discharge orifice directed in alignment or near alignment with the pole and an orientation rearward, generally meant to mean away from forward. With the rod alongside the pole, the pole is effective in pulling and pushing the head through nearly 180 degrees. Slight movement of the pole covers an orientation, for example fully rearward, not achieved by rotation of the head. Turning the pole on its axis obtains the complementary 180 degrees. Thus, the discharge orifice can be directed effectively a full 360 degrees, During use, with one hand on the actuator intermediate the pole, the operator's other hand is on a handle on the pole distal end that includes a trigger. Typically, a spray gun with a trigger is attached to the pole proximal end. Pulling the trigger opens pressurized fluid into and through the center of the pole and through a pole nozzle connector at the pole distal end to which the nozzle base is attached. Clearly, a conduit running along the outside of the pole between the nozzle connector and the pole connector is equivalent and is deemed included in this invention.

BRIEF DESCRIPTION OF THE DRAWINGS

FIG. 5 is a side view the manifold that connects the base to the head with a bolt positioned to thread into the end of the manifold.

FIG. 6 is a side view of the lever.

FIG. 7 is a side view of the base with hidden lines showing internal structure.

FIG. 8 is a side view of the head with hidden lines showing internal structure.

FIG. 9 is a side view of the lever positioned to fit between the base and the head.

DETAILED DESCRIPTION OF THE PREFERRED EMBODIMENTS

Figure 2:
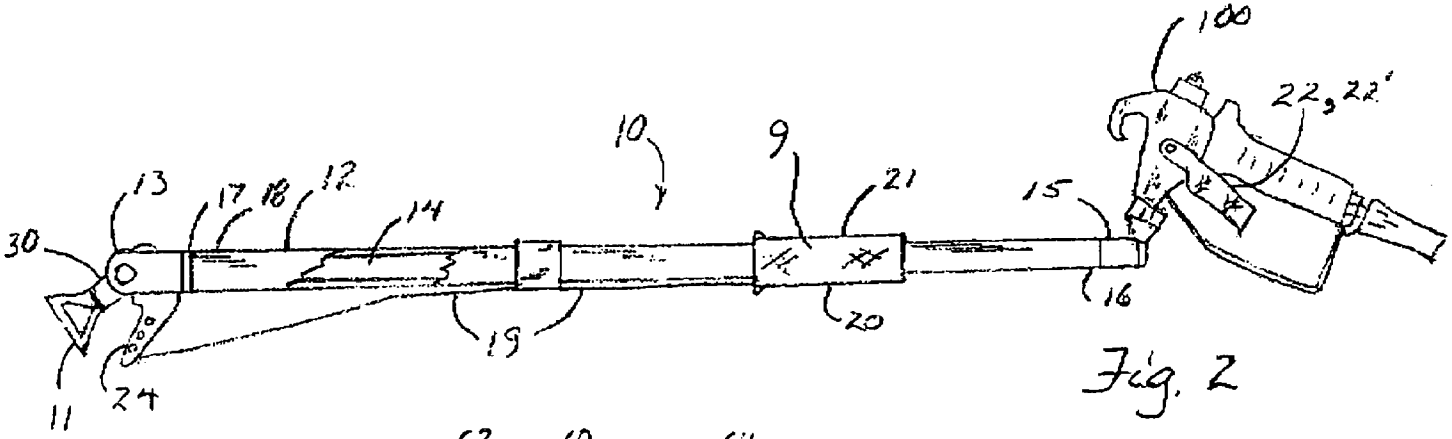
FIG. 2 is a perspective view of the swivel nozzle of FIG. 1 on the distal end of an extension pole showing a rod connecting a lever on the swivel nozzle to a sliding grip on the extension pole.
Figure 1:
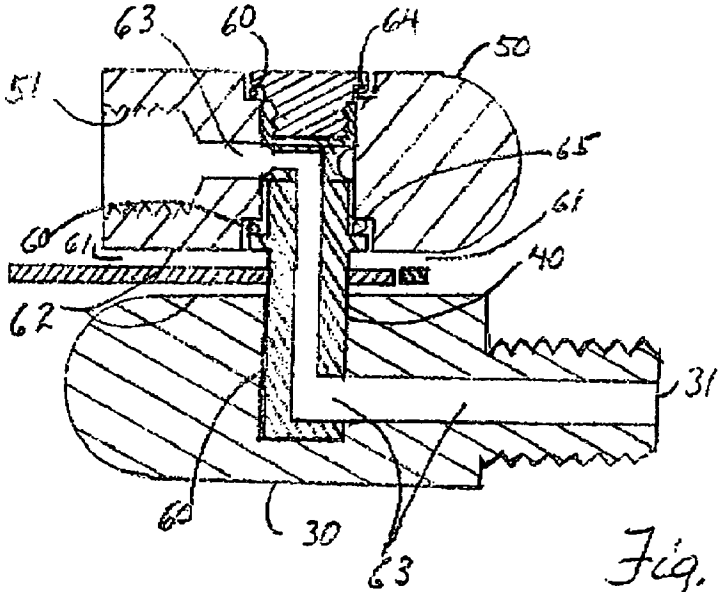
FIG. 1 is a cross-sectional view of the swivel nozzle of the present invention.
Figure 3:
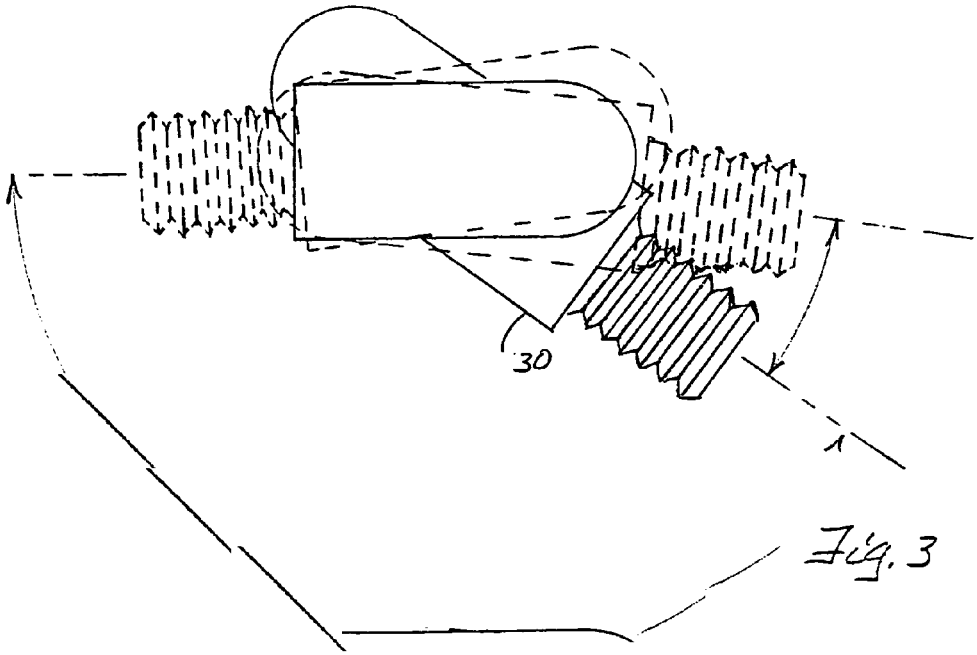
FIG. 3 is top view of the swivel nozzle of claim 1 showing various swivel positions of the head relative to the base.
Figure 4:
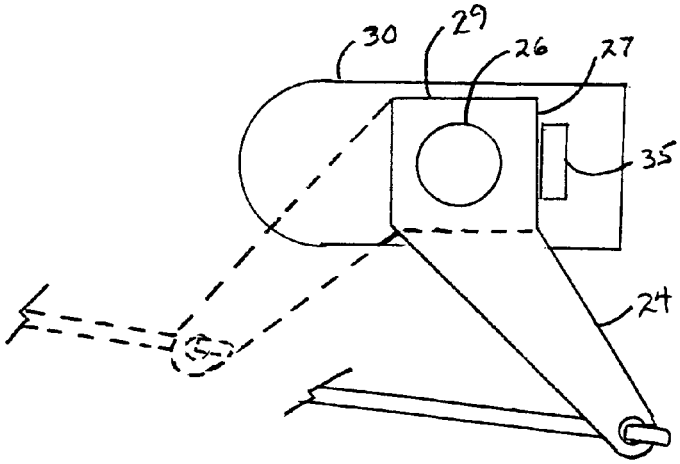
FIG. 4 is a side view of the head of the swivel nozzle showing the lever positioned on the head.
Figure 10:
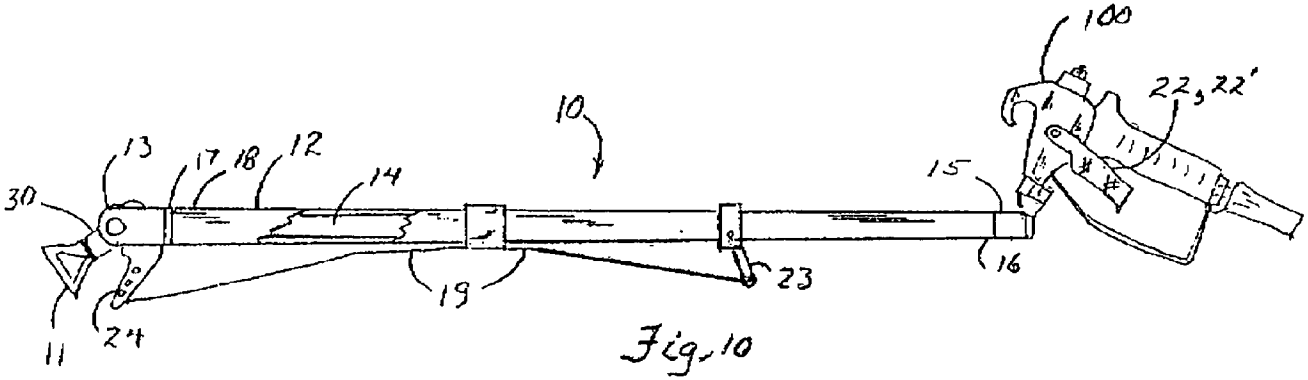
FIG. 10 is a pole arm on the pole as an alternative to the sliding grip.
Figure 11:
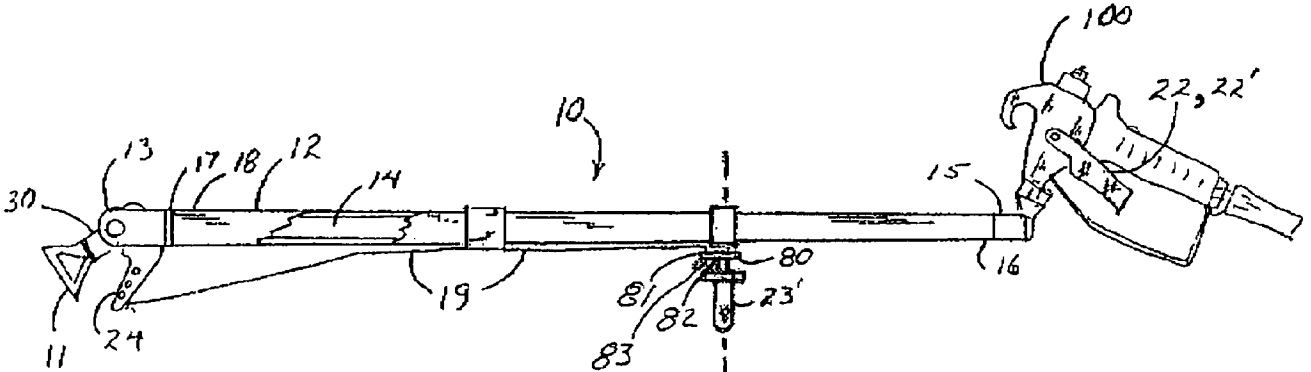
FIG. 11 is a pivoting handle grip on the pole as an alternative to the sliding grip.
Figure 12:
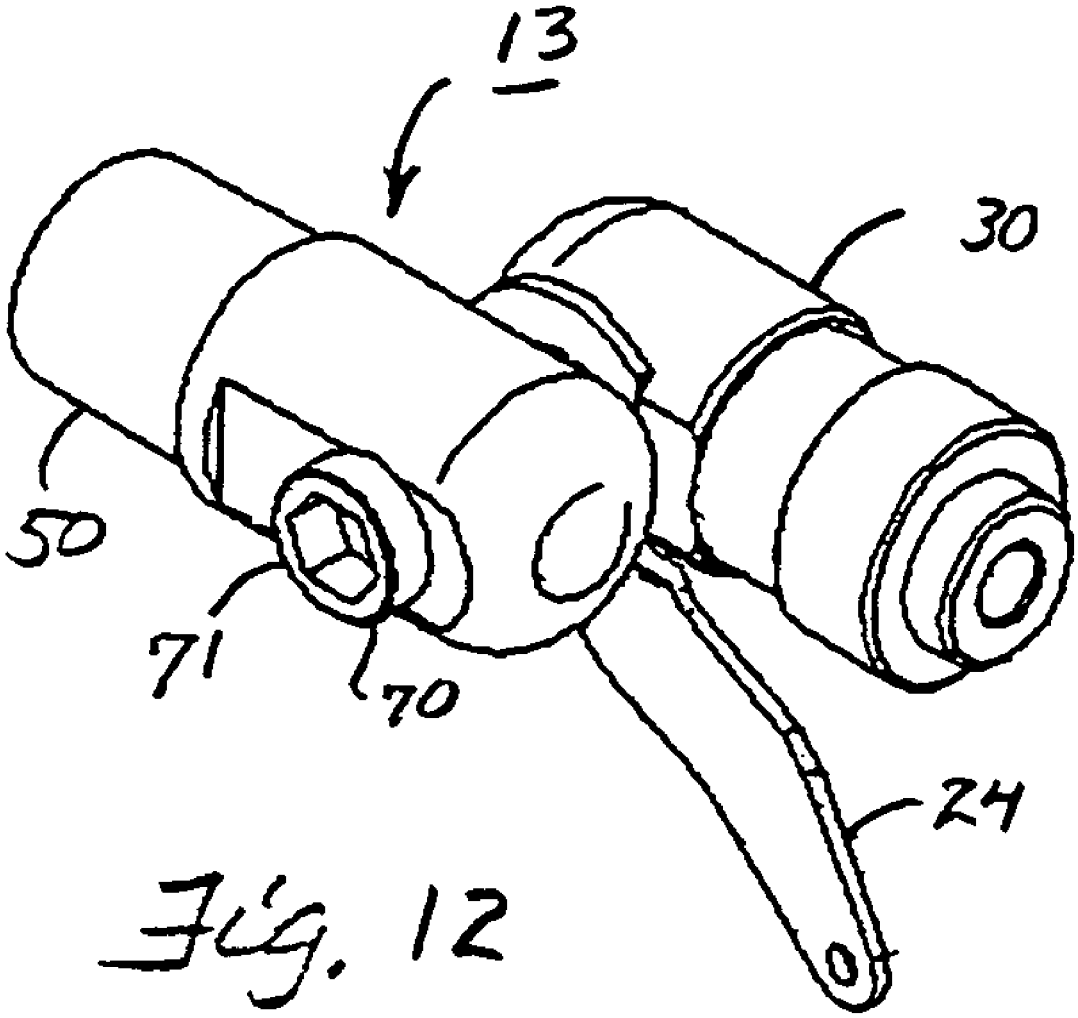
FIG. 12 is a perspective view of the swivel nozzle.

The portable remote swivel nozzle assembly 10 of the present invention incorporates adjustable orientation of a spray rip 11 for spraying pressurized fluids apart from an operator. It comprises an extension pole 12 through which fluid can pass and a swivel nozzle 13 that includes a swivel nozzle head 30. The pole 12 is tubular with a pole passageway 14 therethrough as a fluid conduit between a pole connector 15 on the pole proximal end 16 and the nozzle connector 17 on the pole distal end 18. A rod 19 connects an actuator 20 to the swivel nozzle head 30 to communicate movement of the actuator 20 to the head 30 in adjusting orientation of the head 30 relative to the pole 12. Preferably the actuator 20 comprises a hand grip 21 slidable on the extension pole 12 near the pole proximal end 16 the hand grip further comprising a grip portion 9 adapted to receive a user's hand, the pole 12 slideably passing through the grip portion 9. Necessarily, the hand grip rearward, that is toward the pole proximal end, of a connection of the rod to the hand grip is without an obstruction extending therefrom that might impede said operator's hand from grasping the hand grip around the grip portion. Sliding of the hand grip 21 on the pole then changes orientation of the head 30 in a range of up to approximately 180 degrees relative to the pole 12. The hand grip 21 also serves as a pole hold position that an operator uses to brace the pole 12 with a first hand while the operator's other hand operates a fluid-regulating trigger 22 on the pole proximal end operationally connected to regulate flow of pressurized fluid through the pole 12 to the nozzle connector 17. Typically, a spray gun 100 with a trigger 22 is attached to the extension pole proximal end 16. The trigger 22 then comprises a spray gun trigger 22"that regulates flow from the spray gun 100 into the extension pole 12 and therefore through the swivel nozzle 13 to the spray tip 11.

Though the sliding hand grip 21 is the preferred embodiment, any other mechanism on the pole 12 that serves to adjust the head orientation is deemed equivalent and included in the invention. For example, as a first alternative embodiment, a pivoting pole arm 23 mounted at a fixed position on the pole 12 and connected to the head 30 through the rod 19 also suffices to change orientation of the head 30 relative to the pole 12. The pole arm 23 doubles as a handle for an operator's hand as the operator's other hand is on the pole proximal end. As a second alternative embodiment, a pole arm as a handle grip 23' also mounted at a fixed position on the pole 12 rotates on an axis transverse to the pole in the manner of a motorcycle handle grip and also mechanically connects to the head 30 through the rod 19 such that rotation of the handle grip 23' causes the head to rotate. In this embodiment, the rod 19 pivotably connects to a lug 80 at a lug distal end 81 spaced apart from the axis with a lug proximal end 82 affixed to the hand grip 21 such that as the hand grip 21 rotates on its axis, the lug 80 also rotates with a rod end 83 pivoting in the lug distal end 81 as the lug distal end 81 moves forward toward the pole distal end 18 or rearward toward the pole proximal end 16.

To facilitate movement of the head 30, a lever 24 is attached to the head 30 extending outward therefrom to which the rod 19 is attached therein connecting the actuator 20 to the head 30. The lever 24 may be adjusted in its attachment to the head to achieve a different range of head movement. The head ranges between limits of movement when the actuator 20 is fully extended and when the actuator 20 is fully withdrawn.

The swivel nozzle 13 further comprises a manifold 40 swivelly connecting the swivel nozzle head 30 to a swivel nozzle base 50 with fluid seals 60 between the manifold 40 and the head 30 and between the manifold 40 and the base 50 to prevent leaks. The head 30 is spaced apart from the base 50 on the manifold 40 with a continuous air gap 61 between all base and head opposing surfaces 62 to eliminate frictional engagement between them to enable ease of rotation of the head 30 relative to the base 50. Where the head 30 rotates on the base 50 with minimal friction to accommodate quick and facile remote adjustment of head orientation, the lever 24 also serves to maintain the head 30 properly oriented during high-pressure fluid discharge from the head 30.

A base connector 51, which is typically a threaded hole matching a threading rod in the pole nozzle connector (not shown) in the swivel nozzle base 50 removably attaches to the nozzle connector 17. Typically, but not necessarily, the base 50 swivels on the manifold 40 and the head 30 is rigidly attached to the manifold 40. The head 30 may also swivel on the manifold 40, in which case a base fluid seal 52 is provided between the manifold 40 and the base 50. Connecting passageways 63 in the base, manifold and head provide continuous fluid communication between the base connector 51 and a discharge orifice 31 in the head 30 through which fluid is provided to the spray tip 11 attached to the head 30. Upper and lower O-rings 64 and 65 spaced apart around the manifold 40 between the manifold 40 and the base 50 provide the required fluid seal.

The base 50 has a base bore 53 perpendicular to a base axis 54 running longitudinally with the base 50 into which the manifold 40 swivelly fits. A base passageway 55 connects between the base bore 53 and a base entry orifice 56 at the base connector 51.

The manifold 40 has an axis 41 that runs longitudinally with the manifold 40 and a manifold axial passageway 42 axially through the manifold 40. A manifold upper passageway 43 runs radially from the manifold axis 41 between the manifold axial passageway 42 and the base passageway 55. A manifold upper circumferential groove 44 intersects the manifold upper passageway 43 between the upper and lower O-rings 64 and 65 coplanar with the base passageway 55 therein providing fluid communication between the base entry orifice 56 through the base passageway 55 to the manifold upper circumferential groove 44 and then to the manifold axial passageway 42. Thus, the O-rings 64 and 65 establishing a fluid seal between the base 50 and the manifold 40 such that fluid from the base entry orifice 56 flows only into the manifold axial passageway 42 and the head 30 is adjustable through a full 360-degree revolution relative to the base 50.

Similarly, the head 30 has a head axis 32 that runs longitudinally with the head 30 and a head bore 33 perpendicular to the head axis 32 receiving a portion 45 of the manifold 40. Preferably, the manifold 40 is integrated into the head 30 by a press fit into the head bore 33, precluding movement of the head 30 on the manifold 40 and inherently providing the required fluid seal 60 between manifold 40 and the head 30. A head passageway 34 runs between the head bore 33 and the head discharge orifice 31. The manifold 40 also has a manifold lower passageway 46 radial from the manifold axis 41 in fluid communication with the head passageway 34, the manifold 40 thus providing fluid connection between the base connector 51 in the base 50 and the discharge orifice 31 in the head 30.

The manifold 40 is secured in base bore 53 by a bolt 70 with a bolt head 71 threaded into matching threads 47 in the manifold axial passageway 42 at its head end 48. Equivalently, the manifold may have a partition 49 that separates the axial passageway 42 from a threaded bolt hole 42' in the manifold head end 48.

The base 50 further includes upper and lower recesses 57 and 57' opening upward and downward, respectively, outward from the base 50 that form upper and lower shoulders 58 and 58' around the base bore 53. The upper and lower O-rings 64 and 65 are located on the upper and lower shoulders 58 and 58', respectively. The manifold 40 also includes an annular shelf 49 circumferential about the manifold 40 and intermediate its length. Thus, as the bolt 70 tightens into the manifold 40 pulling the manifold shelf 49 and the bolt head 71 together from opposite sides of the base 50, the upper O-ring 64 is compressed between the bolt head 71 and the upper shoulder 58 and the lower O-ring 65 is compressed between the annular shelf 49 and the lower shoulder 58'. The O-rings 64 and 65, and especially, the lower O-ring 64, is thus housed within the swivel nozzle 13 in the base bore 53 to protect them from damage during use. Preferably, the lower recess 57' and annular shelf 49 is sized such that the shelf 49, and thus the lower O-ring 65, also fits inside the lower recess 57' when the bolt 70 is tightened to maintain continuous, unobstructed opposing surfaces between the head 30 and base 50.

The manifold 40 is generally cylindrical of a constant diameter modified therefrom only by the manifold upper circumferential groove 44 and the annular shelf 49 and at least comprises a cylindrical surface 25 between the base 50 and the head 30 passing through a hole 26 in the lever 24. The head 30 also comprises a lug 35 extending from the head 30 toward the base 50 with a flat 36 opposing a lever flat 27 such that when the lever 24 is rotated, the lever flat 27 engages the lug 35, or head flat, causing the head 30 to rotate, therein adjusting orientation of the head 30 relative to the base 50. The lever 24 typically also comprises a second lever flat 29 so the lever 24 can be rotated on the manifold 40 relative to the head 30 such that the second flat 29 opposes the lug, or head flat 35, thus changing the range of orientation of the head 30 when the lever 24 is moved by the actuator 20.

Having described the invention, what is claimed is as follows:

1. A portable remote swivel nozzle assembly with adjustable spray orientation for spraying pressurized fluids, comprising:

a portable extension pole with a proximal end and a distal end, a swivel nozzle including a base immovably affixed to the pole distal end and a head swivelly connected to the base, the swivel nozzle having a through passageway between the pole distal end and a discharge orifice in the head, a hand grip slidable on the pole causing the head to rotate relative to the base-as the hand grip slides on the pole, the hand grip and the swivel nozzle head being mechanically linked to communicate movement of the hand grip to the head such that all sliding movements of the hand grip on the pole causes rotation of the head on the base the hand grip further comprising a grip portion adapted to receive a user's hand, the pole slidably passing through the grip portion.

2. The apparatus of claim 1 wherein the hand grip is adapted as a pole hold accepting an operator's first hand in bracing the pole while the operator's other hand operates a trigger during dispersal of fluid from the spray nozzle wherein the hand grip rearward, that is toward the pole proximal end, of a connection of the rod to the hand grip is without an obstruction extending therefrom that might impede said operator's hand from grasping the hand grip around the grip portion.

3. A portable remote swivel nozzle assembly with adjustable spray orientation for spraying pressurized fluids, comprising:

a portable extension pole with a proximal end and a distal end, a swivel nozzle including a base immovably affixed to the pole distal end and a head swivelly connected to the base, the swivel nozzle having a through passageway between the pole distal end and a discharge orifice in the head, a pole arm with a longitudinal axis transverse to the pole as a hand grip mounted at a fixed position on the pole and rotatable on said axis, adapted as a pole hold accepting an operator's first hand in bracing the pole while the operator's other hand operates a trigger during dispersal of fluid from the spray nozzle, a rod functionally connecting the hand grip and the head such that rotation of the hand grip on its axis causes the head to rotate, the rod held against rotation by the user's first hand in opposing reaction forces of fluid expelled through the nozzle head when the user's first hand is simultaneously bracing the pole on the hand grip wherein the rod pivotably connects to a lug at a lug distal end spaced apart from said axis with a lug proximal end affixed to the hand grip such that as the hand grip rotates on its axis, the lug also rotates with a rod end pivoting in the lug distal end as the lug distal end moves forward toward the pole distal end or rearward toward the pole proximal end.

4. A portable remote swivel nozzle assembly with adjustable spray orientation for spraying pressurized fluids, comprising:

a portable extension pole with a proximal end and a distal end, a swivel nozzle including a base connected to the pole distal end at a swivel nozzle base connector and a head swivelly connected to the base, the swivel nozzle having a through passageway between the pole distal end and a discharge orifice in the head, an actuator on the extension pole, wherein the actuator and the swivel nozzle head are mechanically linked to communicate movement of the actuator to the head in adjusting orientation of the head relative to the base, a lever attached to the head extending outward therefrom to which a rod is attached connecting the actuator to the head, the lever positioned relative to the head such that the head is directed mostly forward when the actuator is fully extended, and directed away from forward when the actuator is fully withdrawn, and a manifold providing fluid connection between the base and the head, the head firmly connected to the manifold and the base swivelly connected to the manifold each with a fluid seal and having a manifold passageway through the manifold continuing fluid communication between the base connector and the discharge orifice in the head, wherein the manifold includes a cylindrical surface between the base and the head passing through a hole in the lever, the head further comprising a lug extending from the head toward the base with a flat presented toward and engaging the lever flat such that when the lever is rotated, the lever flat engages the head flat which causes the head and manifold to rotate, therein adjusting orientation of the head relative to the base.

5. A portable remote swivel nozzle assembly with adjustable spray orientation for spraying pressurized fluids, comprising:

a portable extension pole with a proximal end and a distal end, a swivel nozzle including a base connected to the pole distal end at a swivel nozzle base connector, a head swivelly connected to the base, the swivel nozzle having a through passageway between the pole distal end and a discharge orifice in the head, and a manifold providing fluid connection between the base and the head, the head connected to the manifold and the base swivelly connected to the manifold each with a fluid seal and having a manifold passageway axially through the manifold continuing fluid communication between the base connector and the discharge orifice in the head, an actuator on the extension pole, wherein the actuator and the swivel nozzle head are mechanically linked to communicate movement of the actuator to the head to rotate the head relative to the base, a plurality of swivel nozzle seals all of which are contained within the swivel nozzle base in sealing the swivel nozzle from fluid leaks, the seals within the swivel nozzle base protecting the seals from damage during use.

6. The apparatus of claim 5 wherein the manifold is integral with the head as a unitary inseparable whole with no relative movement between them, attachable to the base and removable therefrom by action of a bolt threadably engaging a base end of a manifold, securing the manifold to the base.

7. A portable remote swivel nozzle assembly with adjustable spray orientation for spraying pressurized fluids, comprising:

a portable extension pole with a proximal end and a distal end, a swivel nozzle including a base connected to the pole distal end at a swivel nozzle base connector and a head swivelly connected to the base, the swivel nozzle having a through passageway between the pole distal end and a discharge orifice in the head, an actuator on the extension pole, wherein the actuator and the swivel nozzle head are mechanically linked to communicate movement of the actuator to the head in adjusting orientation of the head relative to the base, and wherein the swivel nozzle further includes a manifold providing fluid connection between the base and the head, the head connected to the manifold and the base swivelly connected to the manifold each with a fluid seal and having a manifold passageway axially through the manifold continuing fluid communication between the base connector and the discharge orifice in the head, in which the head is spaced apart from of the base with a continuous air gap between all base and head opposing surfaces in eliminating frictional engagement between them.

8. A portable remote swivel nozzle assembly with adjustable spray orientation for spraying pressurized fluids, comprising:

a portable extension pole with a proximal end and a distal end, a swivel nozzle including a base connected to the pole distal end at a swivel nozzle base connector, a head swivelly connected to the base, the swivel nozzle having a through passageway between the pole distal end and a discharge orifice in the head, and a manifold providing fluid connection between the base and the head, the head connected to the manifold and the base swivelly connected to the manifold each with a fluid seal and having a manifold passageway axially through the manifold continuing fluid communication between the base connector and the discharge orifice in the head, an actuator on the extension pole, wherein the actuator and the swivel nozzle head are mechanically linked to communicate movement of the actuator to the head -to rotate the head relative to the base, a bolt with a head, the bolt threaded into matching threads in the manifold passageway at its base end, the bolt terminating in the manifold within the base, upper and lower O-rings spaced apart around the manifold, wherein the base further includes a base bore perpendicular to a base axis running longitudinally with the base with a base passageway between the base bore and a base entry orifice, and wherein the manifold further comprises a manifold upper passageway radial from a manifold axis that runs longitudinally with the manifold, and a manifold upper circumferential groove intersecting the manifold upper passageway between the upper and lower O-rings and coplanar with the base passageway therein providing fluid communication between the base entry orifice through the base passageway to the manifold upper circumferential groove and then to the manifold axial passageway, the O-rings establishing a fluid seal between the base and the manifold such that fluid from the base entry orifice flows only into the manifold axial passageway.

9. The apparatus of claim 8 wherein the head further includes a head bore perpendicular to a head axis running longitudinally with the head with a head passageway between the head bore and a head discharge orifice, and wherein the manifold further comprises a manifold lower passageway radial from the manifold axis and in fluid communication with the head passageway therein providing fluid communication between the base entry orifice and the head discharge orifice.

10. A portable remote swivel nozzle assembly with adjustable spray orientation for spraying pressurized fluids, comprising:

a portable extension pole with a proximal end and a distal end, a swivel nozzle including a base connected to the pole distal end at a swivel nozzle base connector and a head swivelly connected to the base, the swivel nozzle having a through passageway between the pole distal end and a discharge orifice in the head, an actuator on the extension pole, wherein the actuator and the swivel nozzle head are mechanically linked to communicate movement of the actuator to the head in adjusting orientation of the head relative to the base, and wherein the swivel nozzle further includes a manifold providing fluid connection between the base and the head, the head connected to the manifold and the base swivelly connected to the manifold each with a fluid seal and having a manifold passageway axially through the manifold continuing fluid communication between the base connector and the discharge orifice in the head, a bolt with a head, the bolt threaded into matching threads in the manifold passageway at its base end, the bolt terminating in the manifold within the base, upper and lower O-rings spaced apart around the manifold, wherein the base further includes a base bore perpendicular to a base axis running longitudinally with the base with a base passageway between the base bore and a base entry orifice, and wherein the manifold further comprises a manifold upper passageway radial from a manifold axis that runs longitudinally with the manifold, and a manifold upper circumferential groove intersecting the manifold upper passageway between the upper and lower O-rings and coplanar with the base passageway therein providing fluid communication between the base entry orifice through the base passageway to the manifold upper circumferential groove and then to the manifold axial passageway, the O-rings establishing a fluid seal between the base and the manifold such that fluid from the base entry orifice flows only into the manifold axial passageway, in which the base has upper and lower recesses opening upward and downward, respectively, outward from the base and forming upper and lower shoulders around the base bore, the O-rings positioned on the upper and lower shoulders respectively, and about the manifold and intermediate its length, the upper O-ring compressed between the bolt head and the upper shoulder and the lower O-ring compressed between the annular shelf and the lower shoulder as the bolt tightens into the manifold pulling the manifold shelf and the bolt head together on opposite sides of the base.

11. The apparatus of claim 10 in which the lower recess and annular shelf are sized such that the shelf fits inside the lower recess when the bolt is tightened.

12. A remote portable spray nozzle with adjustable spray orientation for spraying pressurized fluids, comprising:

a portable extension pole with a proximal end and a nozzle connector on a distal end to which pressurized fluid is delivered wherein the pole is tubular with a pole passageway therethrough as a fluid conduit between a pole connector on the pole proximal end and the nozzle connector on the pole distal end, a swivel nozzle including upper and lower O-rings, a base connected to the nozzle connector and having a base bore perpendicular to a base axis running longitudinally with the base with a base passageway between the base bore and a base entry orifice, a manifold swivelly connected to the base and having an axis that runs longitudinally with the manifold and an axial passageway axially through the manifold, a manifold upper passageway radial from the manifold axis, and a manifold upper circumferential groove intersecting the manifold upper passageway between the upper and lower O-rings spaced apart around the manifold and coplanar with the base passageway therein providing fluid communication between the base entry orifice through the base passageway to the manifold upper circumferential groove and then to the manifold axial passageway, the O-rings establishing a fluid seal between the base and the manifold such that fluid from the base entry orifice flows only into the manifold axial passageway, the manifold further having a manifold lower passageway radial from the manifold axis, a head with a head axis that runs longitudinally with the head and having a head bore perpendicular to the head axis receiving a portion of the manifold and a head passageway between the head bore and a head discharge orifice, the manifold lower passageway being in fluid communication with the head passageway, the manifold thus providing fluid connection between the base connector in the base and the discharge orifice in the head, with a fluid seal preventing fluid leakage between the manifold and the head, the head being spaced apart from the base with a continuous air gap between all base and head opposing surfaces in eliminating frictional engagement between them, an actuator on the extension pole comprising a hand grip slidable on the pole near the pole proximal end, adapted to adjust orientation of the head as the hand grip slides on the pole, a rod between the actuator and the swivel nozzle head adapted to communicate movement of the actuator to the head in adjusting orientation of the head relative to the base, the head being adjustable approximately 180 degrees relative to the base by action of the actuator, a lever attached to the head extending outward therefrom to which the rod is attached connecting the actuator to the head, the lever positioned relative to the head such that the head is directed mostly forward, or in near alignment with the pole, when the actuator is fully extended, and directed mostly rearward, or in near counteralignment with the pole, when the actuator is fully withdrawn wherein the head rotates on the base with minimal friction adapted to accommodate quick and facile remote adjustment of head orientation, the lever connected through the rod to the adjustable actuator on the pole maintaining the head properly oriented during high pressure fluid discharge from the head, seals contained within the swivel nozzle sealing the swivel nozzle from fluid leaks between the base and the manifold, the seals being within the swivel nozzle to protect them from damage during use.

13. The apparatus of claim 12 further comprising a bolt with a head, the bolt threaded into matching threads in the manifold passageway at its base end, the bolt terminating in the manifold within the base, the base further having upper and lower recesses opening upward and downward, respectively, outward from the base and forming upper and lower shoulders around the base bore, the O-rings positioned on the upper and lower shoulders respectively, and wherein the manifold includes an annular shelf circumferential about the manifold and intermediate its length, the upper O-ring compressed between the bolt head and the upper shoulder and the lower O-ring compressed between the annular shelf and the lower shoulder as the bolt tightens into the manifold pulling the manifold shelf and the bolt head together on opposite sides of the head, the lower recess and annular shelf sized such that the shelf fits inside the lower recess when the bolt is tightened.

14. A swivel nozzle useful on attachment to an extension pole, comprising a base with a base axis running longitudinally with the base and having a bore therethrough perpendicular to the base axis and a passageway parallel to the axis between the bore and an entry orifice, a base connector on the base at the entry orifice adapted to connect the base to a conduit providing pressurized fluid to the base through the entry orifice, a head swivelly connected to the base and having a through passageway between the base connector and a discharge orifice in the head, all base and head opposing surfaces spaced apart by a continuous air gap between them therein eliminating frictional engagement between said opposing surfaces.

15. The swivel nozzle of claim 14 further comprising a manifold providing fluid connection between the base and the head, the head connected to th manifold and the base swivelly connected to the manifold each with a fluid seal and having a manifold passageway through the manifold continuing fluid communication between the base connector and the discharge orifice in the head.

16. The swivel nozzle of claim 15 wherein the manifold is connected swivelly to the base with a fluid seal therebetween.

17. The swivel nozzle of claim 16 wherein the fluid seal is between the base and the manifold within the base bore.

18. The apparatus of claim 15 wherein the manifold is integrated into the head precluding relative movement between the head and the manifold.

19. The apparatus of claim 15 wherein the manifold is the exclusive interface between the base and the head.

20. The apparatus of claim 15 further comprising a bolt with a head, the bolt threaded into matching threads in the manifold at its base end, upper and lower O-rings engaging the manifold spaced apart around its circumference, and wherein the manifold further comprises a manifold upper passageway radial from a manifold axis, which manifold axis runs longitudinally with the manifold, and a manifold upper circumferential groove intersecting the manifold upper passageway between the upper and lower O-rings and in fluid communication with the base passageway therein providing fluid communication between the base entry orifice through the base passageway to the manifold upper circumferential groove and then to the manifold axial passageway, the O-rings establishing a fluid seal between the base and the manifold such that fluid from the base entry orifice flows only into the manifold axial passageway.

21. The apparatus of claim 20 in which the base has upper and lower recesses opening upward and downward, respectively, outward from the base and forming upper and lower shoulders around the base bore, the O-rings positioned on the upper and lower shoulders respectively, and wherein the manifold includes an annular shelf circumferential about the manifold and intermediate its length, the upper O-ring compressed between the bolt head and the upper shoulder and the lower O-ring compressed between the annular shelf and the lower shoulder as the bolt tightens into the manifold pulling the manifold shelf and the bolt head together on opposite sides of the head.

22. The apparatus of claim 21 in which the lower recess and annular shelf are sized such that the shelf fits inside the lower recess when the bolt is tightened.

23. The apparatus of claim 21 wherein the manifold is cylindrical of a constant diameter modified therefrom only by the manifold upper circumferential groove and the annular shelf.

24. The apparatus of claim 20 wherein the head further includes a head bore perpendicular to a head axis running longitudinally with the head with a head passageway between the head bore and a head discharge orifice, and wherein the manifold further comprises a manifold lower passageway radial from the manifold axis and in fluid communication with the head passageway therein providing fluid communication between the base entry orifice and the head discharge orifice.

25. The swivel nozzle of claim 14 wherein the head further comprises a manifold portion extending therefrom and into the base bore providing fluid connection between the base and the head and having a manifold passageway through the manifold portion contributing to fluid communication between the base connector and the discharge orifice in the head.

26. The apparatus of claim 14 further comprising said fluid seal inside the swivel nozzle with no external exposure, the seals thus protected from damage during use.

27. The apparatus of claim 26 wherein swivel nozzle seals are exclusively inside the swivel nozzle within the base bore.

28. The apparatus of claim 14 wherein the head is adjustable through a full 360-degree revolution relative to the base.

29. A swivel nozzle useful on attachment to an extension pole for spraying pressurized fluids, comprising a base having a base bore perpendicular to a base axis running longitudinally with the base with a base passageway between the base bore and a base entry orifice, a base connector on the base at the entry orifice adapted to connect the base to a conduit providing pressurized fluid to the base through the entry orifice, upper arid lower O-rings, a manifold swivelly connected to the base and having an axis that runs longitudinally with the manifold and an axial passageway axially through the manifold, a manifold upper passageway radial from the manifold axis, and a manifold upper circumferential groove intersecting the manifold upper passageway between the upper and lower O-rings spaced apart around the manifold and in fluid communication with the base passageway therein providing fluid communication between the base entry orifice through the base passageway to the manifold upper circumferential groove and then to the manifold axial passageway, the O-rings establishing a fluid seal between the base and the manifold such that fluid from the base entry orifice flows only into the manifold axial passageway, the manifold further having a manifold lower passageway radial from the manifold axis, the O-rings being within the swivel nozzle to protect them from damage during use.

a head with a head axis that runs longitudinally with the head and having a head bore perpendicular to the head axis receiving a portion of the manifold and a head passageway between the head bore and a head discharge orifice, the manifold lower passageway being in fluid communication with the head passageway, the manifold thus providing fluid connection between the base connector in the base and the discharge orifice in the head, with a fluid seal preventing fluid leakage between the manifold and the head, the head being spaced apart from the base with a continuous air gap between all base and head opposing surfaces in eliminating frictional engagement between them.

30. The apparatus of claim 29 further comprising a bolt with a head, the bolt threaded into matching threads in the manifold at its base end, and in which the base has upper and lower recesses opening upward and downward, respectively, outward from the base and forming upper and lower shoulders around the base bore, the O-rings positioned on the upper and lower shoulders respectively, and wherein the manifold includes an annular shelf circumferential about the manifold and intermediate its length, the upper O-ring compressed between the bolt head and the upper shoulder and the lower O-ring compressed between the annular shelf and the lower shoulder as the bolt tightens into the manifold pulling the manifold shelf and the bolt head together on opposite sides of the head, the lower recess and annular shelf are sized such that the shelf fits inside the lower recess when the bolt is tightened, wherein compression of the O-rings is adjusted by the bolt threading into the manifold.

* * * * *